US006949700B1

(12) United States Patent
Kelly

(10) Patent No.: US 6,949,700 B1
(45) Date of Patent: Sep. 27, 2005

(54) ADJUSTABLE THUMB PICK FOR STRINGED INSTRUMENT

(76) Inventor: Fred Kelly, P.O. Box 532, Grayling, MI (US) 49738-0532

( * ) Notice: Subject to any disclaimer, the term of this patent is extended or adjusted under 35 U.S.C. 154(b) by 32 days.

(21) Appl. No.: 10/617,421

(22) Filed: Jul. 11, 2003

Related U.S. Application Data

(60) Provisional application No. 60/394,752, filed on Jul. 11, 2002.

(51) Int. Cl.[7] ..... G10D 3/16
(52) U.S. Cl. ..... 84/322; 84/320
(58) Field of Search ..... 84/233, 322, 320, 84/321

(56) References Cited

U.S. PATENT DOCUMENTS 2,776,592 A * 1/1957 Di Preta ..... 84/322
3,789,720 A * 2/1974 McIntyre ..... 84/322

* cited by examiner

*Primary Examiner*—Kimberly Lockett

(57) ABSTRACT

The adjustable thumb pick for stringed musical instruments includes a thumb retainer with a band member that forms a thumb passage. The band member has band ends and a band slot. A pick includes an intergral post. The integral post is received in the band slot. An enlarged free end of the post permits the post to rotate relative to the slot. The post can also slide into two or more positions within the slot.

11 Claims, 4 Drawing Sheets

ADJUSTABLE THUMB PICK FOR STRINGED INSTRUMENT

The disclosure incorporates a vehicle mounted storage unit disclosed in provisional patent application 60/394,752, filed Jul. 11, 2002, whose priority is claimed for this application.

TECHNICAL FIELD

The adjustable thumb pick includes a thumb retainer and a pick with an integral post that is received in a slot in the thumb retainer and permits the pick to reposition relative to the slot and to pivot relative to the thumb retainer.

BACKGROUND OF THE INVENTION

Players of some string musical instruments grasp a pick between the thumb and the index finger and move the pick across the strings to create sounds. These picks are generally a thin plastic material with smooth surfaces. To prevent a pick from sliding and pivoting relative to the thumb and index finger, the pick must be tightly held. Holding a pick tightly tends to reduce the flexibility of the pick and thereby changes tonal quality. Holding a pick tightly also tires the thumb, index finger and hand. To over come these problems thumb picks were developed.

Thumb picks, currently employed by some musicians, solve the problems encountered with standard picks. Musicians can play for longer periods of time and produce more consistent tones than was generally possible with standard flat picks.

Thumb picks, as currently used have a fixed relationship between the tip of the pick and the thumb retainer. To change the distance the pick extends outward from the thumb and thereby change the maximum distance the tip can extend into the strings requires a purchase of a new thumb pick with the desired dimensions or shorting the old thumb pick by removing material.

The orientation of the string engaging tip of a pick relative to a musician's thumb depends upon the position in which the instrument is held and the preference of the musician. At one extreme the tip extend outward at a right angle to the long axis of the thumb. In the other extreme position, the pick tip extends outward from the end of the thumb and parallel to the long axis of the thumb. Most musicians prefer positions somewhere between the two extremes. The angular position of the string engaging tip of currently available thumb picks is set during manufacture. A musician must purchase a thumb pick that is made with the desired angular position of the pick relative to the thumb retainer. In many cases the precise angular position is not available and the musician must comprise to some extent.

SUMMARY OF THE INVENTION

The adjustable thumb pick for string musical instruments includes a thumb retainer with a thumb passage to defined by a band with a band outside surface, a band in side surface, and slot through the band. A pick includes a member with a base end, a tip, a first string engaging surface, a second string engaging surface, and an integral post. The integral post is secured to the pick, extends outward from the first string engaging surface and has a post axis. The post extends through the slot through the band, has an enlarged free end that limits movement of the post along the post axis. The post can be positioned in at least two positions along the length of the slot. The tip of the pick is pivotal about the post axis to a selected position.

BRIEF DESCRIPTION OF THE DRAWING

These and other objects, features and advantages will become more readily apparent in view of the following detailed description and best mode, appended claims and accompanying drawings, in which:

DETAILED DESCRIPTION OF THE PREFERRED EMBODIMENTS

Figure 3:
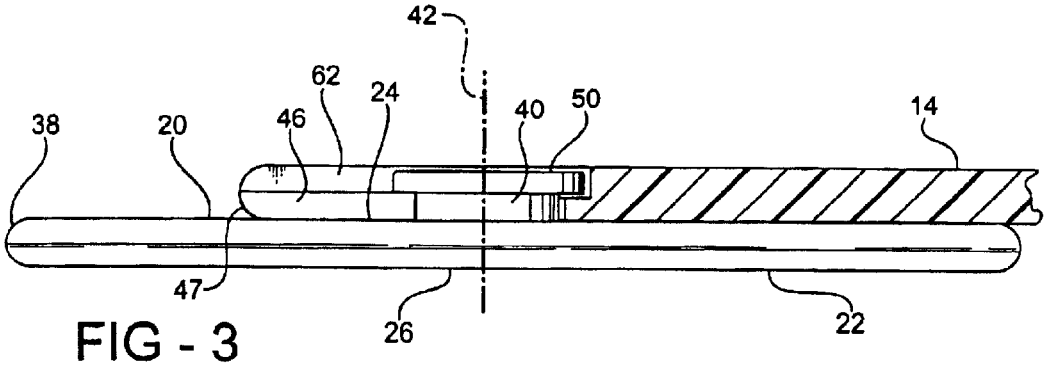
FIG. 3 is an enlarged sectional view taken along line 3—3 in FIG. 1.
Figure 4:
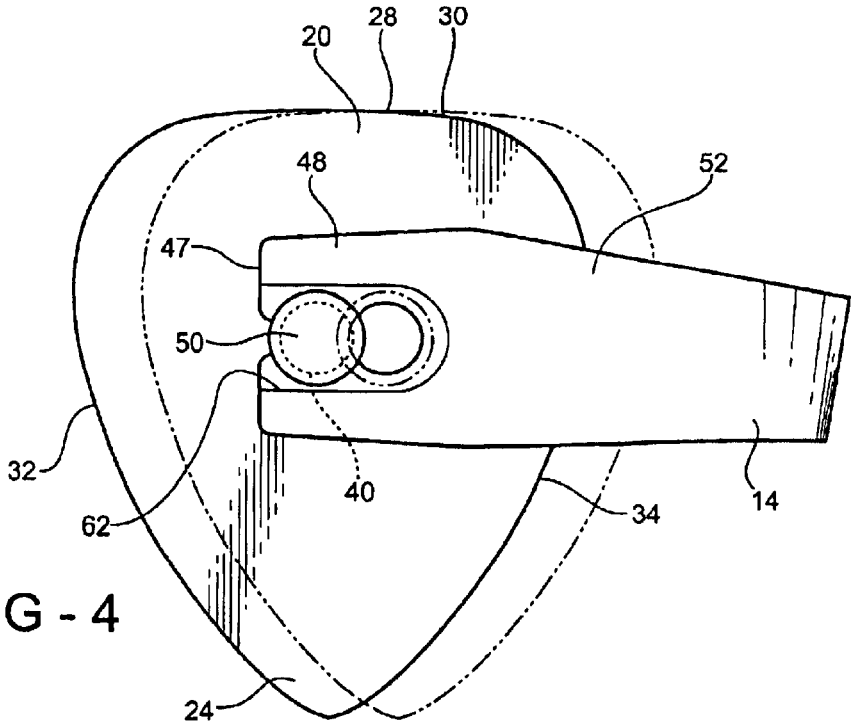
FIG. 4 is a bottom plan view similar to FIG. 1 shown the pick in full lines in one position in a slot through the thumb retainer and showing the pick in broken lines in an alternate position.

The adjustable thumb pick 10 for stringed instruments includes a pick 12 and a thumb retainer 14. The pick 12 is a thin plastic member with a base end 16 and a string engaging end 18. The base end 16 has digit engaging first and second surfaces 20 and 22. The string engaging end 18 is somewhat pointed and has string engaging surfaces 24 and 26. The edge 28 of the base end 16 as shown is a straight or slightly curved center section 30 that most musicians would hold generally parallel to instrument strings during use. Curved end portions of the edge 28 join side edges 32 and 34. The side edges 32 and 34 extend to the tip 36. The tip 36 is arcuate as shown. The side edges 32 and 34 converge toward each other and toward the tip 36. The pick 12 has a substantially uniform thickness and rounded edges 38 as shown in FIG. 3, the side elevational view.

Picks 12 vary in thickness, shape and stiffness. They also vary somewhat in size. Some are described as teardrop shaped while others are described as triangular with round or arcuate tips. The pick shown in U.S. Patent No. Des. 385,293 to Sarno is rectangular with a handle on one side and two rounded corners. Shapes other than those described can be found. The pick 12 shown in the drawing is best described as a teardrop shape. The shape of the pick 12 used for the thumb pick 10 described herein is a matter of choice by the user.

A post 40 is integral with the pick 12 and extends from the first surface 20. The axis 42 of the post 40 is perpendicular to the first and second surfaces 20 and 22.

Figure 1:
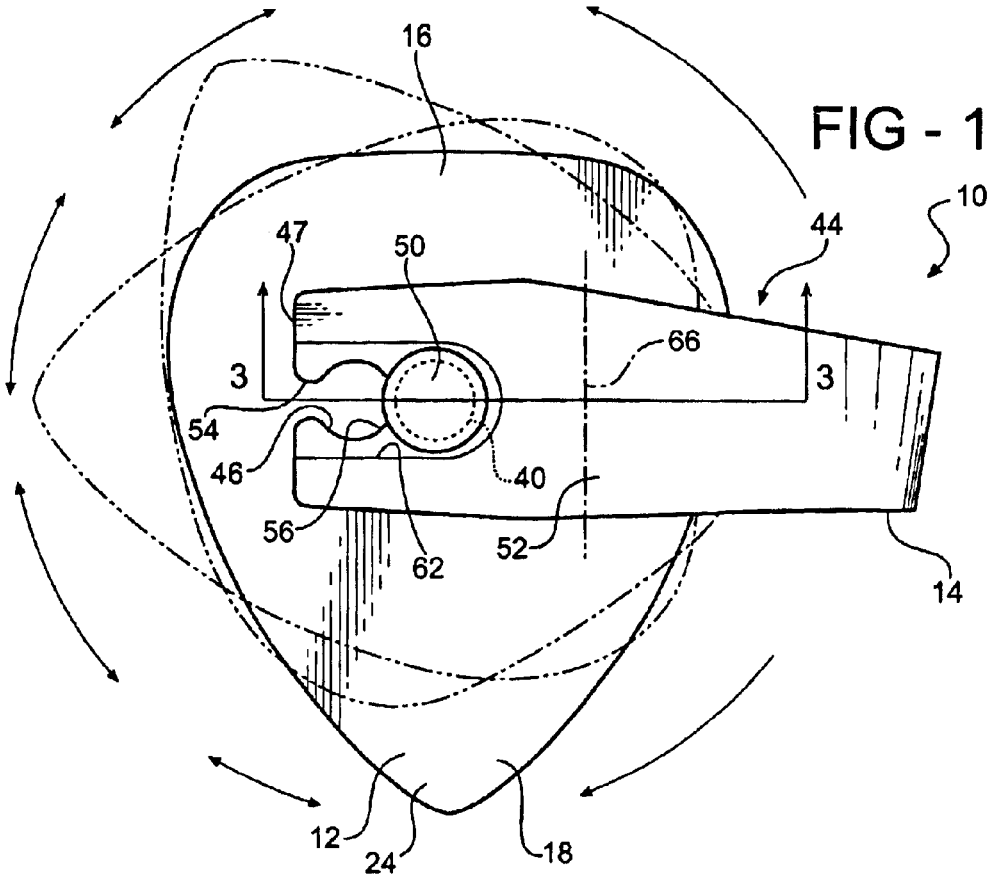
FIG. 1 is a bottom plan view of the thumb pick showing the pick in one position in a full line and showing alternate positions in broken lines.
Figure 2:
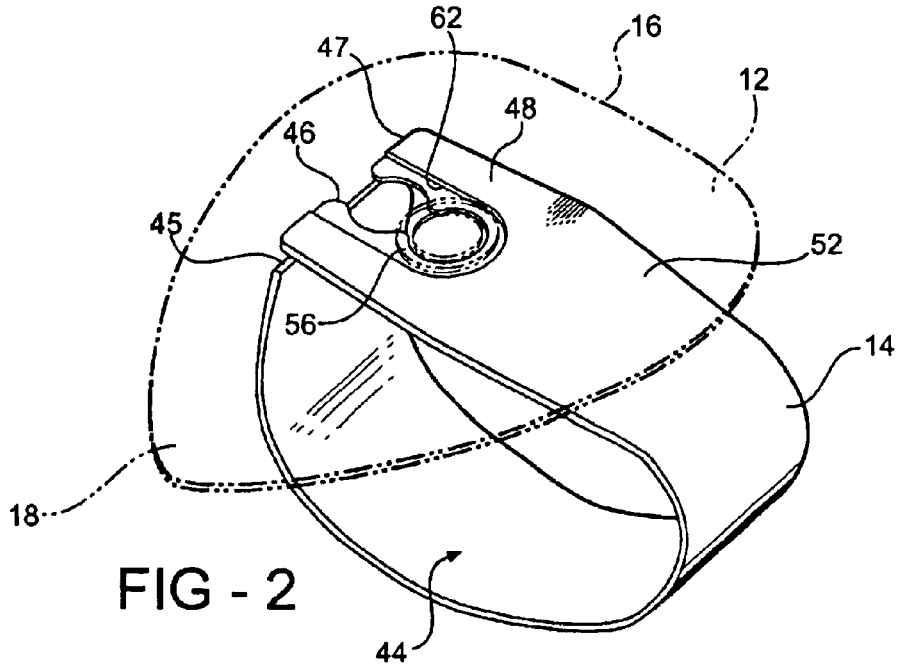
FIG. 2 is prospective view of the thumb retainer and the pick shown in broken lines.

The thumb retainer 14, as shown in FIG. 2, is a band that partially surrounds the end of the thumb of an instrument player. The retainer 14 is able to expand as required to fit the thumbs of various players due to the resilience of the material and the fact that their retainer has band ends 45 and 47 and does not completely encircle a player's thumb. The band ends 45 and 47 are separated by a gap. The thumb passage 44 through the retainer 14 has a semi-conical shape to receive the distal end of a person's thumb. A thumb passage axis 66 extends through the center of the thumb passage 44. The shape is similar to the shape of the thumb pick body shown in U.S. Pat. No. 4,020,732 to Kelly, the disclosure of which is incorporated herein by reference. The retainer 14 for a right handed player has a different shape than the retainer for a left handed person. Retainer 14 may also be provided in different sizes to accommodate instrument players with very small thumbs and players with very large thumbs.

Figure 5:
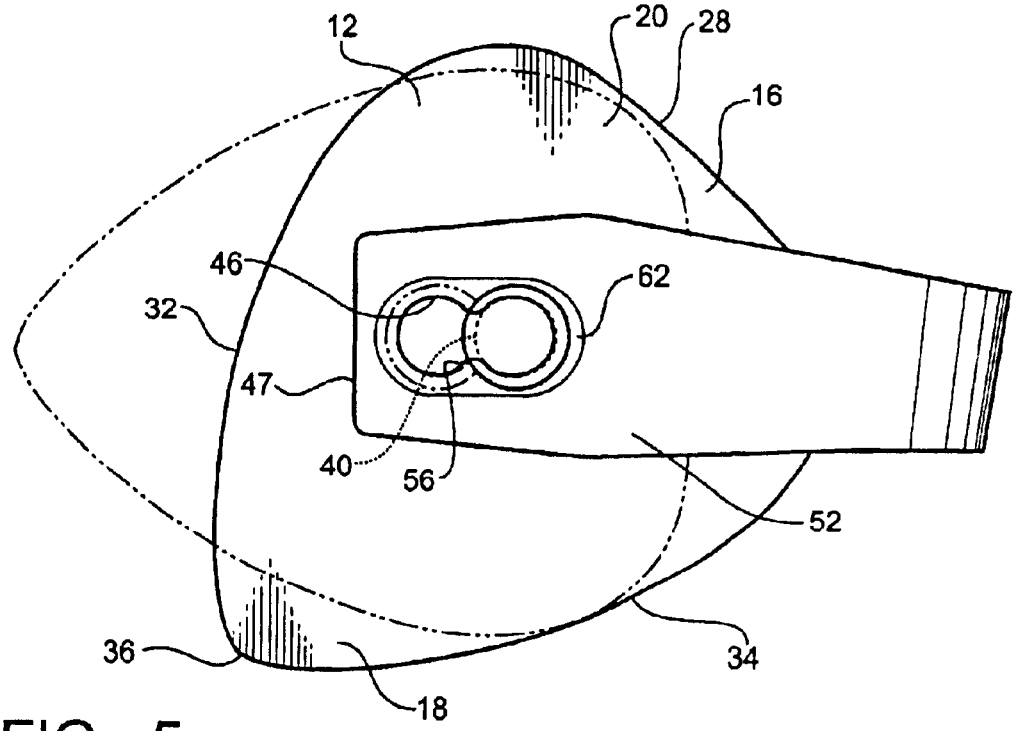
FIG. 5 is a bottom plan view of the thumb pick with an alternate thumb retainer slot construction.
Figure 6:
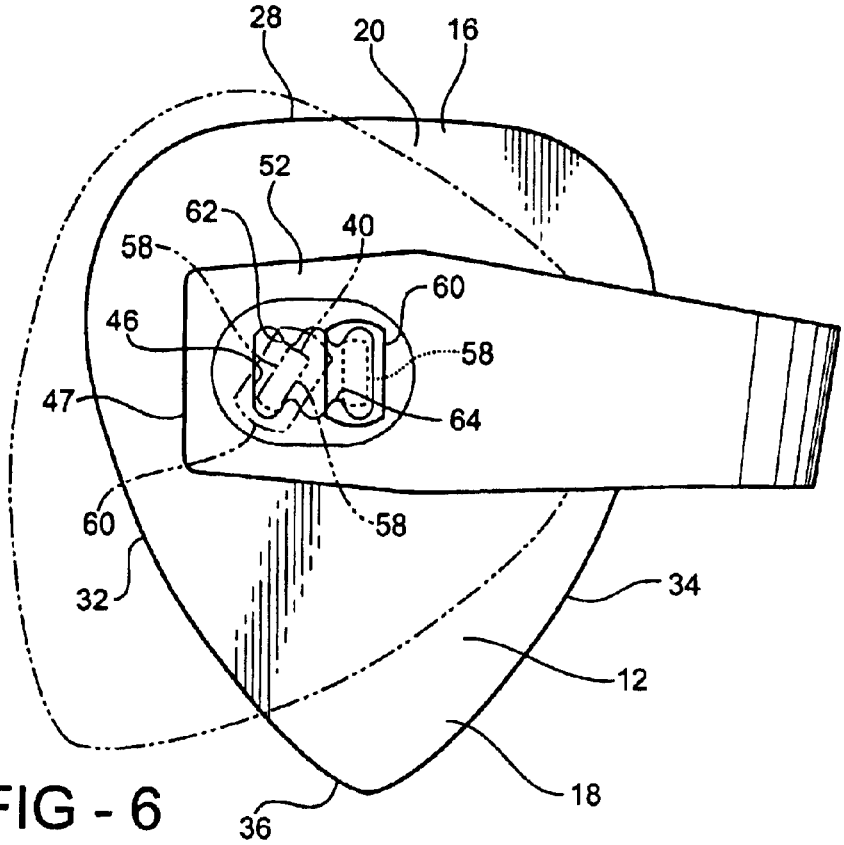
FIG. 6 is a bottom plan view of the thumb pick with an alternate slot and past construction.
Figure 7:
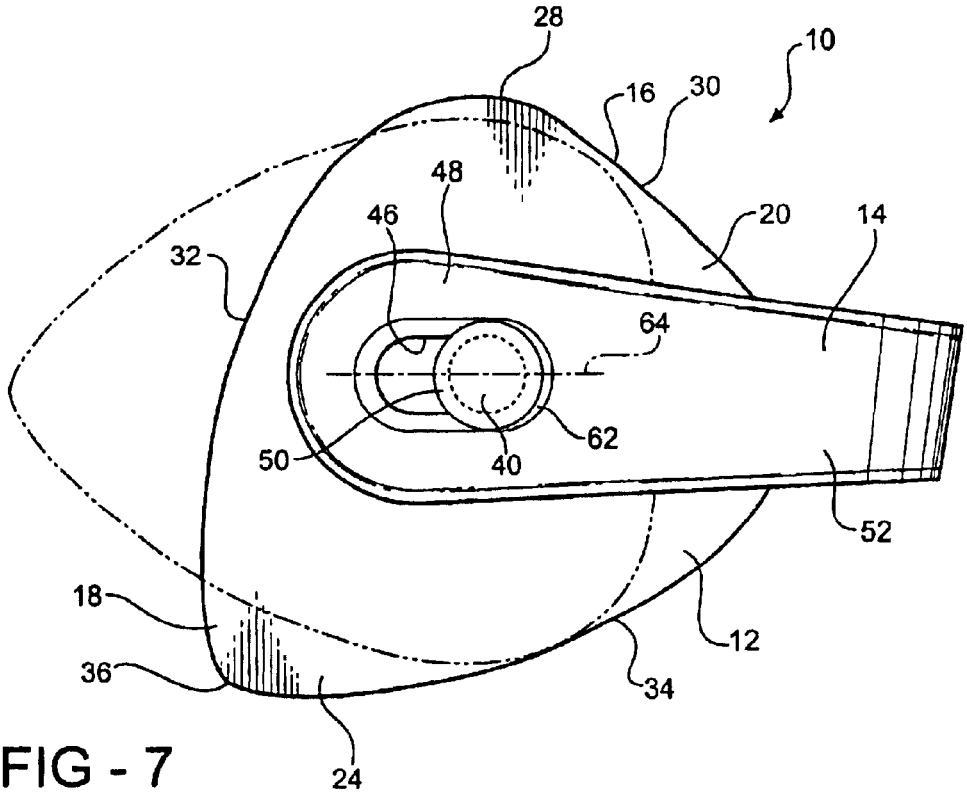
FIG. 7 is a bottom plan view of the thumb pick with an alternate slot construction.

A slot 46 is provided through an end portion 48 of the thumb retainer 14 as shown in FIGS. 1, 2, 3, 4, 5, and 6. The slot 46 as shown has a width that is substantially the same as the diameter of the post 40. The slot 46 has a slot long axis 64. The slot 46 is open through the band end 47 as shown in FIGS. 1, 2, 3 and 4. The slot 46 has closed ends as shown in FIGS. 5, 6 and 7.

The base end 16 of the pick 12 is inserted in to the thumb passage 44 and the post 40 is inserted through the slot 46. The free end 50 of the post 40 is then deformed, as shown in FIG. 3, to hold the post in the slot 46. The post 40 can be deformed by heat. The heat can be provided by a heated tool or by friction between a rotating tool and the post 40. The connection between the pick 12 and the thumb retainer 14 permits rotation of the post 40 in the slot 46 and permits the post 40 to be slid to any chosen position along the length of the slot in the version shown in FIG. 7. The post 40 and the slot 46 cooperate to form a slide connector. This connection is preferably tight so that friction between the pick 12 and the thumb retainer 14 tends to hold the pick in any chosen position along the length of the slot 46 as well as any chosen position about the axis 42 of the post 40.

The slot 46 as shown in FIGS. 1 through 4 has a closed end and an open end. The open end allows the post 40 on the pick 12 to be inserted into the slot 46 through the thumb retainer 14 and to be removed from the slot. Removal of a pick 12 from the slot 46 permits replacement by a pick with different stiffness as well as replacement by an unbroken pick. Resilient tabs 54 permit a post 40 to be forced into or out of the slot 46 and retain the post in the slot during use. Inner tabs for 56 divide the slot 46 into two sections and provide two transverse positions for the pick 12 relative to the thumb retainer 14.

The slot 46 shown in FIG. 5 as two closed ends and two resilient inner tabs 56. With this embodiment, the pick 12 can not be separated from the thumb retainer 14. The inner tabs 56 hold the post 40 and a selective end of the slot 46 during use. The post 40 can be shifted past the inner tabs 56 and into one end of the slot 46 or the other end by applying force manually.

The slot 46 with a closed ends, shown in FIG. 6, receives a post 40 with two flat side surfaces 58 and a generally rectangular top retainer 60. The top retainer 60 can past through the slot 46 when the pick 12 is rotated into a non-use position. This construction allows the pick 12 to be removed from the thumb retainer 14 and replaced by another pick. Tabs 62 and 64 cooperate with the portion of the post 40 with flats 58 to hold the pick 12 in three different positions along the length of the slot 46.

The embodiment shown in FIG. 7 has a slot 46 with a width that is substantially the same width as the diameter of the main section of the post 40. No tabs extend into the slot 46. The constant width slot 46 permits the pick 12 to be positioned any place between the ends of the slot. The free end 50 and the diameter of the post 40 cooperate with the thumb retainer 14 to provide a tight fit that tends to hold the pick 12 in a selected position relative to the thumb retainer 14.

The free end 50 of the post 40 is preferably received in a recess 62. The recess 62 permits the enlarged free end 50 of the post 40 to move along the length of the slot 46. The depth of the recess 62 is substantially the same as the height of the deformed free end 50 of the post 40 as shown in FIG. 3.

During use of the thumb pick 10, the pick 12 is positioned in the slot 46 in a chosen location and rotated about the axis 42 to a desired position. A player inserts his thumb into the thumb passage 44 with his thumb in contact with the second surface 22 on the pick 12. The side of the player's index finger contacts the free end SO of the post 40 and the outer surface 52 of the thumb retainer 14. Squeezing the thumb pick 10 between a player's thumb and index finger and the cooperation between the thumb retainer 14 and the player's thumb holds the pick in the position chosen by the player.

Rotation of the pick 12 about the axis 42 permits the player to hold his pick hand in a comfortable orientation relative to the musical instrument. Sliding the post 40 in the slot 46 adjusts the position of the tip 46 relative to the player's thumb and adjusts penetration of the tip 36 of the pick into the instrument strings.

It is to be understood that other embodiments of the invention which accomplish the same function are incorporated herein within the scope of any ultimately allowed patent claims.

What is claimed is:

1. An adjustable thumb pick for string musical instruments comprising:

a thumb retainer including a band member that forms a thumb passage with a thumb passage axis;

a pick including a pick tip with a first sting engaging surface and a second string engaging surface, and a base end;

a pivot connector pivotally connecting the pick to the band member for pivotal movement and wherein the pivot connector includes a post integral with the pick and rotatably attached to the thumb retainer; and a slide connector slidably connecting the pick to the thumb retainer.

2. An adjustable thumb pick for stringed musical instrument, as set forth in claim 1, where in the post of the slide connector is slidably received in a slot and permits the pick to slide along a path generally transverse to the thumb passage axis.

3. An adjustable thumb pick for stringed musical instruments comprising:

a thumb retainer with a thumb passage defined by a band with a band outside surface, a band in side surface, and a slot through the band;

a pick including a member with a base end, a tip, a first string engaging surface, a second string engaging surface, and an integral post secured to the member, extending outward from the first string engaging surface and having a post axis; and wherein the post extends through the slot through the band, has an enlarged free end that limits movement the post along the post axis and relative to the thumb retainer, and the post is positionable in at least two positions along the length of the slot and the tip is pivotable about the post axis to a selected tip position.

4. An adjustable thumb pick for stringed musical instruments, as set forth in claim 3, wherein the slot through the band has a closed end and an open end.

5. An adjustable thumb pick for stringed musical instruments, as set forth in claim 3, wherein the slot through the band has a pair of closed ends.

6. An adjustable thumb pick for stringed musical instruments, as set forth in claim 5, wherein the slot through the band includes at least one inner tab that selectively positions the integral post and the post axis in two positions between the pair of closed ends.

7. An adjustable thumb pick for stringed musical instruments, as set forth in claim 5, wherein the position of the integral post and the post axis in the slot through the band is infinitely variable between the pair of closed ends.

8. An adjustable thumb pick for stringed musical instruments, as set forth in claim 4, wherein the slot through the band has at least one tab adjacent to the open end which resists movement of the integral post and the post axis from the slot through the band.

9. An adjustable thumb pick for stringed musical instruments, as set forth in claim 7, wherein the band has a pair of band ends and the pick extends through a gap between the pair of band ends.

10. An adjustable thumb pick for stringed musical instruments, as set forth in claim 3, wherein the first string engaging surface of the pick is in sliding contact with the band inside surface.

11. An adjustable thumb pick for stringed musical instruments, as set forth in claim 3, wherein the post axis is perpendicular to a long axis of the slot through the band.

* * * * *